US009595408B2

(12) United States Patent
Fischer et al.

(10) Patent No.: US 9,595,408 B2
(45) Date of Patent: Mar. 14, 2017

(54) ELECTRICAL SYSTEM AND OPERATING HANDLE INTERFACE ASSEMBLY THEREFOR

(71) Applicant: EATON CORPORATION, Cleveland, OH (US)

(72) Inventors: Kenneth Martin Fischer, Finleyville, PA (US); David Curtis Turner, Imperial, PA (US); Raymond Peter Gundy, II, Indiana, PA (US)

(73) Assignee: EATON CORPORATION, Cleveland, OH (US)

( * ) Notice: Subject to any disclaimer, the term of this patent is extended or adjusted under 35 U.S.C. 154(b) by 163 days.

(21) Appl. No.: 14/527,986

(22) Filed: Oct. 30, 2014

(65) Prior Publication Data

US 2016/0126034 A1 May 5, 2016

(51) Int. Cl.

| | |
|---|---|
| ***H01H 21/36*** | (2006.01) |
| ***H01H 21/22*** | (2006.01) |
| ***H01H 9/26*** | (2006.01) |
| ***H01H 71/10*** | (2006.01) |

(52) U.S. Cl.

CPC ..... *H01H 21/22* (2013.01); *H01H 9/26* (2013.01); *H01H 71/1018* (2013.01); *H01H 21/36* (2013.01); *H01H 2009/265* (2013.01); *H01H 2221/052* (2013.01)

(58) Field of Classification Search

CPC . H01H 2300/018; H01H 9/26; H01H 11/0018

USPC ..... 200/50.32, 50.21, 1 R

See application file for complete search history.

(56) References Cited

U.S. PATENT DOCUMENTS

| | | | | |
|---|---|---|---|---|
| 6,194,983 | B1 | 2/2001 | Bogdon et al. | |
| 7,186,933 | B2 | 3/2007 | Turner | |
| 7,462,792 | B1 * | 12/2008 | Hellmers | H01H 9/26 200/50.33 |
| 2008/0245645 | A1 * | 10/2008 | Dolinski | H01H 3/30 200/401 |

* cited by examiner

*Primary Examiner* — Renee Luebke
*Assistant Examiner* — Ahmed Saeed
(74) *Attorney, Agent, or Firm* — Eckert Seamans; Grant Coffield

(57) ABSTRACT

An operating handle interface assembly is for an electrical system. The electrical system includes an enclosure having an interior and an exterior, and a plurality of electrical switching apparatus disposed within the interior. Each of the electrical switching apparatus includes an operating handle. The operating handle interface assembly includes a linking assembly structured to interconnect the operating handles of a plurality of the electrical switching apparatus. An elongated shaft includes opposing first and second ends. The first end cooperates with one of the operating handles of one of the electrical switching apparatus. The second end is disposed on the exterior of the enclosure. A handle attachment is coupled to the second end of the elongated shaft on the exterior of the enclosure. The handle attachment is operable among a plurality of positions to correspondingly operate the operating handles of all of the interconnected electrical switching apparatus.

16 Claims, 3 Drawing Sheets

ELECTRICAL SYSTEM AND OPERATING HANDLE INTERFACE ASSEMBLY THEREFOR

BACKGROUND

Field

The disclosed concept relates generally to electrical systems and, more particularly, to electrical systems employing a plurality of electrical switching apparatus, such as for example, circuit breakers, housed within an enclosure. The disclosed concept also relates to operating handle interface assemblies for electrical systems.

Background Information

Electrical switching apparatus, such as circuit breakers, provide protection for electrical systems from electrical fault conditions such as, for example, current overloads, short circuits, abnormal voltage and other fault conditions. Molded case circuit breakers, for example, include at least one pair of separable contacts that are operated (e.g., opened; closed; tripped open) either manually by way of an operating handle disposed on the exterior of the circuit breaker, or automatically by way of a trip unit, in response to such a fault condition.

Circuit breakers are often mounted within the interior of an enclosure or cabinet, such as a switchboard or panel board, as part of an electrical system (e.g., without limitation, power distribution system). In certain applications, it may be desirable to actuate the operating handle of the circuit breaker from a location outside of the enclosure, for example and without limitation, without being required to open the enclosure and individually identify, and separately actuate access, the circuit breaker. Additionally, circuit breakers are often mounted within such enclosures in pairs or groups. It may be desirable under certain circumstances to operate more than one circuit breaker together, simultaneously, rather than separately manually operating the operating handles of each separate circuit breaker individually. Accurately and effectively performing such functions poses a number of unique design challenges.

There is, therefore, room for improvement in electrical systems, and in operating handle interface assemblies therefor.

SUMMARY

These needs and others are met by embodiments of the disclosed concept, which are directed to an operating handle interface assembly for electrical systems.

As one aspect of the disclosed concept, an operating handle interface assembly is provided for an electrical system. The electrical system comprises an enclosure having an interior and an exterior, and a plurality of electrical switching apparatus disposed within the interior. Each of the electrical switching apparatus includes an operating handle. The operating handle interface assembly comprises: a linking assembly structured to interconnect the operating handles of a plurality of the electrical switching apparatus; an elongated shaft including a first end and second end disposed opposite and distal from the first end, the first end being structured to cooperate with one of the operating handles of one of the electrical switching apparatus, the second end being structured to be disposed on the exterior of the enclosure; and a handle attachment structured to be coupled to the second end of the elongated shaft on the exterior of the enclosure. The handle attachment is operable among a plurality of positions to correspondingly operate the operating handles of all of the interconnected electrical switching apparatus.

The linking assembly may comprise a number of linking members and a mounting assembly structured to mount the linking members to the operating handles of the interconnected electrical switching apparatus. The mounting assembly may comprise a plurality of pivot plates, a plurality of adapters, and a plurality of fasteners. Each of the adapters may be structured to be coupled to a corresponding one of the operating handles, each of the pivot plates may be fastened to a corresponding one of the adapters by a number of the fasteners, and the linking members may be pivotably coupled to the pivot plates to interconnect the operating handles.

As another aspect of the disclosed concept, an electrical system comprises: an enclosure having an interior and an exterior; a plurality of electrical switching apparatus disposed within the interior, each of the electrical switching apparatus including an operating handle; and an operating handle interface assembly comprising: a linking assembly interconnecting the operating handles of a plurality of the electrical switching apparatus, an elongated shaft including a first end and second end disposed opposite and distal from the first end, the first end cooperating with one of the operating handles of one of the electrical switching apparatus, the second end being disposed on the exterior of the enclosure, and a handle attachment coupled to the second end of the elongated shaft on the exterior of the enclosure. The handle attachment is operable among a plurality of positions to correspondingly operate the operating handles of all of the interconnected electrical switching apparatus.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
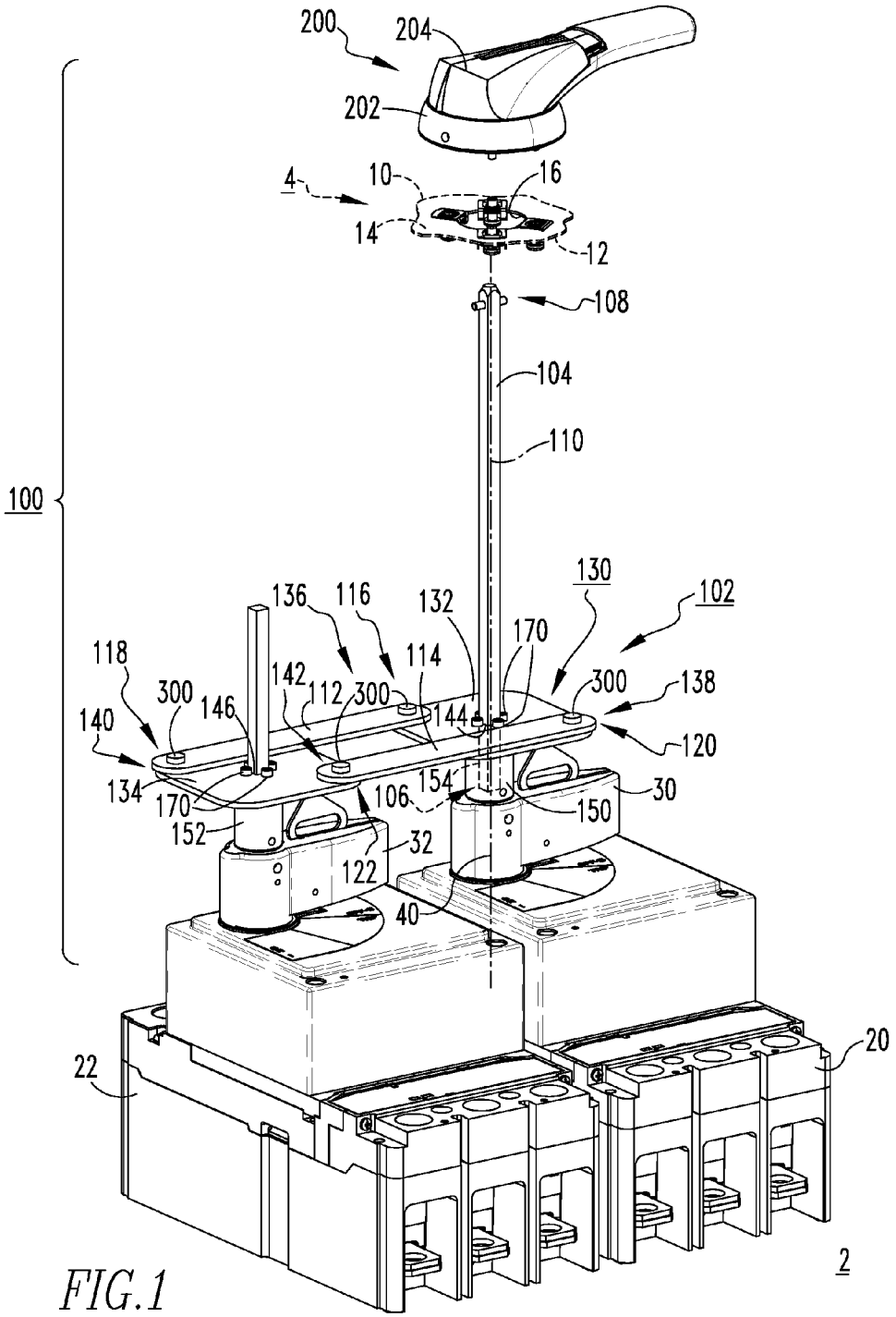
FIG. 1 is an isometric view of an operating handle interface assembly in accordance with an embodiment of the disclosed concept.

Solely for purposes of illustration, the disclosed concept is shown and described herein as applied to a pair of molded case circuit breakers each employing a closely-coupled trip indicator. It will be appreciated, however, that the disclosed concept could also be applied to other types of electrical switching apparatus (e.g., without limitation, circuit switching devices and other circuit interrupters such as contactors, motor starters, motor controllers and other load controllers) having any known or suitable type of operating handle or handle attachment (e.g., non-closely coupled actuating levers and indicators) coupled thereto, and being arranged together in any suitable plurality and configuration.

Directional phrases used herein, such as, for example, left, right, clockwise, counterclockwise and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, rivets, rivnuts, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or more than one (i.e., a plurality).

Figure 2:
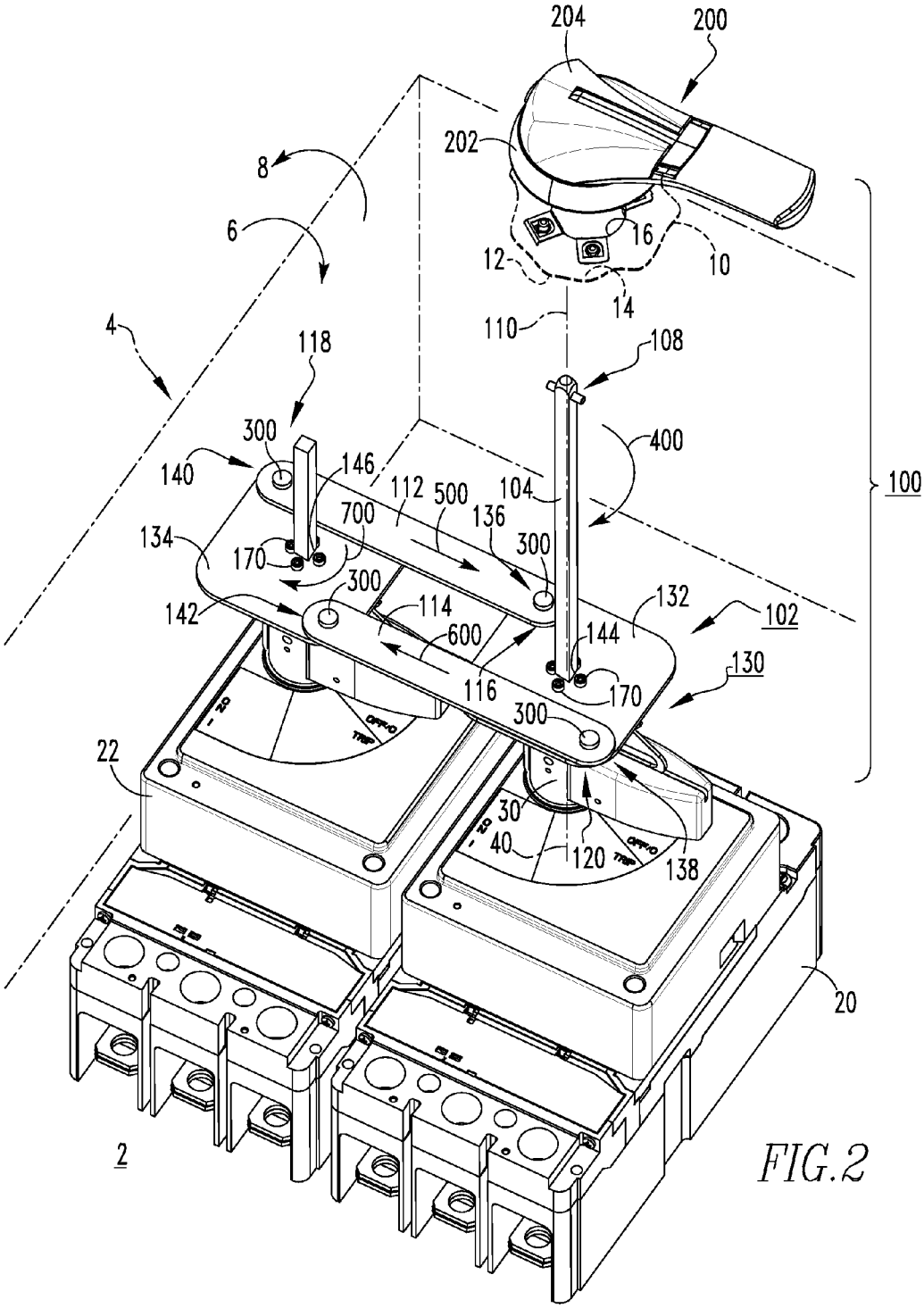
FIG. 2 is another isometric view of the operating handle interface assembly of FIG. 1, also showing a portion of an enclosure of an electrical system in simplified form in phantom line drawing.

FIGS. 1 and 2 show a portion of an electrical system 2 employing an operating handle interface assembly 100 (shown in partially exploded view in FIGS. 1 and 2), in accordance with one non-limiting example embodiment of the disclosed concept. The electrical system 2 includes an enclosure 4 (partially shown in simplified form in phantom line drawing in FIG. 2) having an interior 6 and an exterior 8. A plurality of electrical switching apparatus such as, for example and without limitation, circuit breakers 20,22 (two are shown), are disposed within the interior 6. Each of the electrical switching apparatus 20,22 includes a corresponding operating handle 30,32.

The operating handle interface assembly 100 includes a linking assembly 102, which is structured to interconnect the operating handles 30,32 of a plurality of the electrical switching apparatus 20,22. The operating handle interface assembly 100 further includes an elongated shaft 104 having opposing first and second ends 106,108. The first end 106 is structured to cooperate with one of the operating handles 30 of one of the circuit breakers 20. The second end 108 of the elongated shaft 104 is structured to be disposed on the exterior 8 of the enclosure 4. A handle attachment 200 is coupled to the second end 108, and is operable among a plurality of positions to correspondingly simultaneously operate the operating handles 30,32 of all of the interconnected electrical switching apparatus (e.g., without limitation, first and second circuit breakers 20,22).

Figure 3:
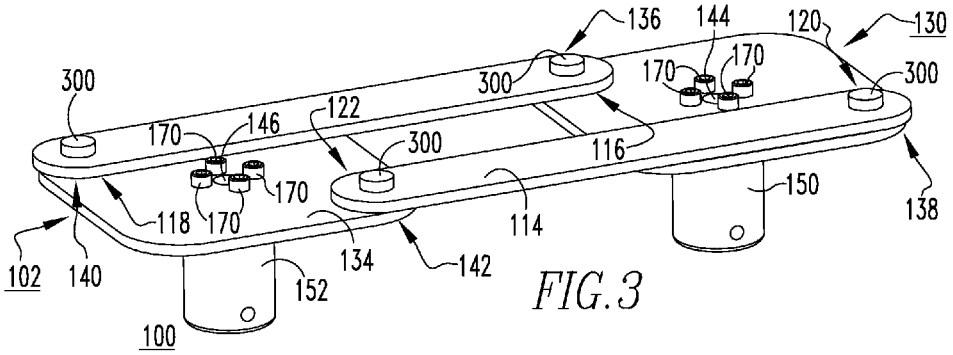
FIG. 3 is an isometric view of a portion of the operating handle interface assembly of FIG. 2.
Figure 4:
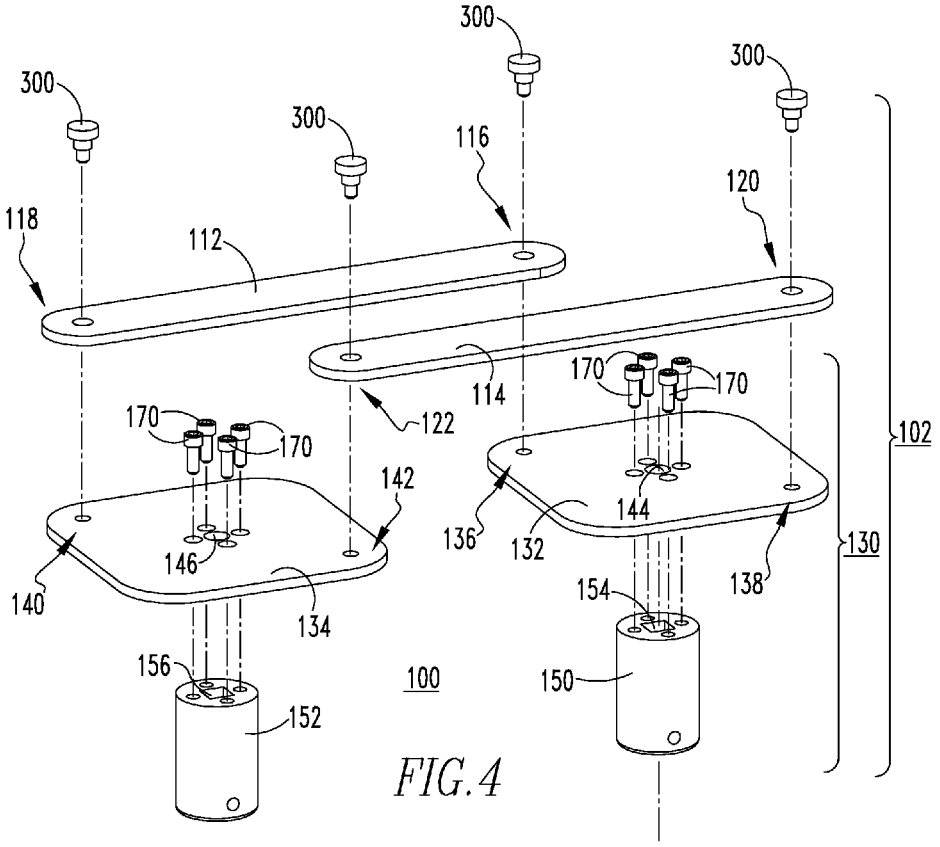
FIG. 4 is an exploded isometric view of the portion of the operating handle interface assembly of FIG. 3.

Continuing to refer to FIGS. 1 and 2, and also to FIGS. 3 and 4, the linking assembly 102 includes a number of linking members 112,114 (two are shown) and a mounting assembly 130. The mounting assembly 130 mounts the linking members 112,114 to the operating handles 30,32 of the interconnected circuit breakers 20,22, respectively. The mounting assembly 130 of the example operating handle interface assembly 100 includes a plurality of pivot plates 132,134 (two are shown), a plurality of adapters 150,152 (two are shown), and a plurality of fasteners 170 (four are shown for each pivot plate 132,134). Each adapter 150,152 is structured to be coupled to a corresponding one of operating handles 30,32. Each of the pivot plates 132,134 is, in turn, fastened to a corresponding one of the adapters 150,152 by a number of the fasteners 170, as shown. The aforementioned linking members 112,114 are pivotably coupled to the pivot plates 132,134, for example and without limitation, by way of pivot pins 300, to interconnect the circuit breaker operating handles 30,32.

Accordingly, in operation, movement (e.g., without limitation, rotation clockwise in the direction of arrow 400 of FIG. 2) of the handle attachment 200 causes the elongated shaft 104 to correspondingly rotate, which in turn rotates the pivot plate 132 and corresponding circuit breaker operating handle 30. Responsive to the pivot plate 132 rotating (e.g., without limitation, clockwise in the direction of arrow 400 of FIG. 2), linking member 112 moves (e.g., without limitation, to the right in the direction of arrow 500 of FIG. 2) and linking member 114 moves (e.g., without limitation, to the left in the direction of arrow 600 of FIG. 2). This, in turn, causes pivot plate 134 to move (e.g., without limitation, rotate clockwise in the direction of arrow 700 of FIG. 2). Thus, it will be appreciated that movement of the singular handle attachment 200 on the exterior 8 of the electrical system enclosure 4 (FIG. 2) results in corresponding movement and operation of all of the circuit breaker operating handles 30,32, which are interconnected by the linking assembly 102. It will, therefore, be appreciated that, among other benefits, the disclosed operating handle interface assembly 100 advantageously permits such operation of a plurality of circuit breakers 20,22, or other suitable electrical switching apparatus (not shown), simultaneously, using one single pivotable handle 204. Moreover, such operation can be performed from the exterior 8 of the electrical system enclosure 4, without requiring the enclosure 4 to be opened.

It will be appreciated that any known or suitable alternative number, type and/or configuration of electrical switching apparatus (not shown) could be suitably interconnected by a suitable variation of the operating handle interface assembly (not shown), without departing from the scope of the disclosed concept. For example and without limitation, a suitable operating handle interface assembly (not shown), in accordance with an alternative non-limiting example embodiment of the disclosed concept, could be employed to interconnect more than two circuit breakers (e.g., 20,22).

As best shown in FIGS. 3 and 4, the linking assembly 102 of the example operating handle interface assembly 100 includes a first pivot arm 112 and a second pivot arm 114. The first and second pivot arms 112,114 each respectively include a first end 116,118 and second end 120,122 disposed opposite and distal from the first end 116,118. In the example shown and described herein, each of the pivot plates 132,134 is a generally square member having a first corner portion 136,138 and a second corner portion 140,142, which is disposed diagonally opposite the first corner portion 136, 140. The first end 116, of the first pivot arm 112 is pivotably coupled to the first corner portion 136 of the first pivot plate 132, and the second end 118 of the first pivot arm 112 is pivotably coupled to the first corner portion 140 of the second pivot plate 134. Similarly, the first end 120 of the second pivot arm 114 is pivotably coupled to the second corner portion 138 of the first pivot plate 132, and the second end 122 of the second pivot arm 114 is pivotably coupled to the second corner portion 142 of the second pivot plate 134. It is this configuration of the pivot arms 112,114 and pivot plates 132,134 that permits the aforementioned simultaneous movement of the plurality of circuit breaker operating handles 30,32 (FIGS. 1 and 2).

Referring again to FIG. 1, each of the adapters 150,152 is respectively disposed between the operating handle 30,32 of a corresponding one of the circuit breakers 20,22 and a corresponding one of the pivot plates 132,134. Each operating handle 30,32 has a pivot axis (see, for example, pivot axis 40 of operating handle 30). Each pivot plate 132,134 has a central aperture 140,146, respectively. Central aperture 140 of pivot plate 132 is aligned with the pivot axis 40 of operating handle 30. Further, each of the adapters 150,152 includes an axial bore hole 154,156 (best shown in FIG. 4). Axial bore hole 154 is aligned with the pivot axis 40 of operating handle 30. Each axial bore hole 154,156 is also aligned with the central aperture 140,146 of a corresponding one of the pivot plates 132,134, as best shown in FIG. 4.

Continuing to refer to FIG. 1, the elongated shaft 104 has a longitudinal axis 110, which aligns with the pivot axis 40 of operating handle 30. The first end 106 of the elongated shaft 104 extends through the central aperture 144 of pivot plate 132 and into the axial bore 154 (shown in hidden line drawing in FIG. 1) of the adapter 150 that is coupled to the operating handle 30. In this manner, the elongated shaft 104 is suitably secured to the desired circuit breaker operating handle 30 such that it moves (e.g., without limitation, pivots) with the operating handle 30, but not independently with respect thereto. Accordingly, movement of the handle attachment 200 coupled to the second end 108 of the elongated shaft 104 correspondingly moves the operating handle 30 of first circuit breaker 20 and, by virtue of the operating handle interface assembly 100 interconnecting the first and second circuit breakers 20,22, also correspondingly moves the operating handle 32 of the second circuit breaker 22, as previously discussed hereinabove.

In the example of FIGS. 1 and 2, the handle attachment 200 includes a base 202 and a pivotable handle 204, which is suitably coupled to the base 202 in a generally well known manner. The pivotable handle 204 is also coupled to the second end 108 of the elongated shaft 104, as previously described. The example enclosure 4 includes a cover member 10 (e.g., without limitation, door or panel member (partially shown in simplified form in phantom line drawing)). The cover member 10 has a first side 12 facing the interior 6 of the enclosure 4, a second side 14 facing the exterior 8 of the enclosure 4, and a thru hole 16. The second end 108 of the elongated shaft 104 is structured to extend through the thru hole 16. The base 202 of the handle attachment 200 is structured to be suitably mounted to the second side 14 of the cover member 10 in a generally well known manner.

Accordingly, the disclosed operating handle interface assembly 100 provides a relatively simple and low cost, yet effective mechanism for operating a plurality of electrical switching apparatus (e.g., without limitation, circuit breakers 20,22) simultaneously. Further, such simultaneous operation can be advantageously achieved from a distal position, such as for example and without limitation, on the exterior 8 of the electrical system enclosure 4, without requiring the enclosure 4 to be opened.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An operating handle interface assembly for an electrical system, said electrical system comprising an enclosure having an interior and an exterior, and a plurality of electrical switching apparatus disposed within the interior, each of said electrical switching apparatus including an operating handle, said operating handle interface assembly comprising:

a linking assembly structured to interconnect the operating handles of a plurality of said electrical switching apparatus;

an elongated shaft including a first end and second end disposed opposite and distal from the first end, the first end being structured to cooperate with one of the operating handles of one of said electrical switching apparatus, the second end being structured to be disposed on the exterior of said enclosure; and a handle attachment structured to be coupled to the second end of said elongated shaft on the exterior of said enclosure, wherein said handle attachment is operable among a plurality of positions to correspondingly operate the operating handles of all of said interconnected electrical switching apparatus;

wherein said linking assembly comprises a number of linking members and a mounting assembly structured to mount said linking members to the operating handles of said interconnected electrical switching apparatus; and wherein said mounting assembly comprises a plurality of pivot plates, a plurality of adapters, and a plurality of fasteners; wherein each of said adapters is structured to be coupled to a corresponding one of the operating handles; wherein each of said pivot plates is fastened to a corresponding one of said adapters by a number of said fasteners; and wherein said linking members are structured to be pivotably coupled to said pivot plates to interconnect the operating handles.

2. The operating handle interface assembly of claim 1 wherein said number of linking members is a plurality of pivot arms each including a first end and a second end disposed opposite and distal from the first end; wherein the first end is pivotably coupled to one of said pivot plates; and wherein the second end is pivotably coupled to another one of said pivot plates.

3. The operating handle interface assembly of claim 2 wherein said mounting assembly further comprises a plurality of pivot pins; and wherein said pivot pins pivotably couple said pivot arms to said pivot plates.

4. The operating handle interface assembly of claim 2 wherein said plurality of pivot plates is a first pivot plate and a second pivot plate each comprising a generally square planar member having a first corner portion and a second corner portion disposed diagonally opposite the first corner portion; wherein said plurality of pivot arms is a first pivot arm and a second pivot arm; wherein the first end of said first pivot arm is pivotably coupled to the first corner portion of said first pivot plate; wherein the second end of said first pivot arm is pivotably coupled to the first corner portion of said second pivot plate; wherein the first end of said second pivot arm is pivotably coupled to the second corner portion of said first pivot plate; and wherein the second end of said second pivot arm is pivotably coupled to the second corner portion of said second pivot plate.

5. The operating handle interface assembly of claim 1 wherein each of said adapters is structured to be disposed between the operating handle of a corresponding one of said interconnected electrical switching apparatus and a corresponding one of said pivot plates; wherein each of the operating handles includes a pivot axis; wherein each of said pivot plates includes a central aperture structured to be aligned with the pivot axis of a corresponding one of the operating handles; and wherein each of said adapters includes an axial bore hole structured to be aligned with the pivot axis of a corresponding one of the operating handles and to be aligned with the central aperture of a corresponding one of said pivot plates.

6. The operating handle interface assembly of claim 5 wherein said elongated shaft further includes a longitudinal axis structured to align with the pivot axis of one of the operating handles; and wherein the first end of said elongated shaft is structured to extend through the central aperture and into the axial bore hole of the adapter coupled to said one of the operating handles.

7. The operating handle interface assembly of claim 1 wherein said handle attachment includes a base and a pivotable handle coupled to the base; and wherein said pivotable handle is coupled to the second end of said elongated shaft.

8. The operating handle interface assembly of claim 7 wherein said enclosure includes a cover member; wherein said cover member has a first side facing the interior of said enclosure, a second side facing the exterior of said enclosure, and a thru hole; wherein the second end of said elongated shaft is structured to extend through said thru hole; and wherein the base of said handle attachment is structured to be mounted to the second side of said cover member.

9. An electrical system comprising:

an enclosure having an interior and an exterior;

a plurality of electrical switching apparatus disposed within the interior, each of said electrical switching apparatus including an operating handle; and an operating handle interface assembly comprising:

a linking assembly interconnecting the operating handles of a plurality of said electrical switching apparatus, an elongated shaft including a first end and second end disposed opposite and distal from the first end, the first end cooperating with one of the operating handles of one of said electrical switching apparatus, the second end being disposed on the exterior of said enclosure, and a handle attachment coupled to the second end of said elongated shaft on the exterior of said enclosure, wherein said handle attachment is operable among a plurality of positions to correspondingly operate the operating handles of all of said interconnected electrical switching apparatus;

wherein said linking assembly comprises a number of linking members and a mounting assembly for mounting said linking members to the operating handles of said interconnected electrical switching apparatus; and wherein said mounting assembly comprises a plurality of pivot plates, a plurality of adapters, and a plurality of fasteners; wherein each of said adapters is coupled to a corresponding one of the operating handles; wherein each of said pivot plates is fastened to a corresponding one of said adapters by a number of said fasteners; and wherein said linking members are pivotably coupled to said pivot plates to interconnect the operating handles.

10. The electrical system of claim 9 wherein said number of linking members is a plurality of pivot arms each including a first end and a second end disposed opposite and distal from the first end; wherein the first end is pivotably coupled to one of said pivot plates; and wherein the second end is pivotably coupled to another one of said pivot plates.

11. The electrical system of claim 10 wherein said mounting assembly further comprises a plurality of pivot pins; and wherein said pivot pins pivotably couple said pivot arms to said pivot plates.

12. The electrical system of claim 10 wherein said plurality of electrical switching apparatus is two circuit breakers mounted side-by-side within the interior of said enclosure; wherein said plurality of pivot plates is a first pivot plate and a second pivot plate each comprising a generally square planar member having a first corner portion and a second corner portion disposed diagonally opposite the first corner portion; wherein said plurality of pivot arms is a first pivot arm and a second pivot arm; wherein the first end of said first pivot arm is pivotably coupled to the first corner portion of said first pivot plate; wherein the second end of said first pivot arm is pivotably coupled to the first corner portion of said second pivot plate; wherein the first end of said second pivot arm is pivotably coupled to the second corner portion of said first pivot plate; and wherein the second end of said second pivot arm is pivotably coupled to the second corner portion of said second pivot plate.

13. The electrical system of claim 9 wherein each of said adapters is disposed between the operating handle of a corresponding one of said interconnected electrical switching apparatus and a corresponding one of said pivot plates; wherein each of the operating handles includes a pivot axis; wherein each of said pivot plates includes a central aperture aligned with the pivot axis of a corresponding one of the operating handles; and wherein each of said adapters includes an axial bore hole aligned with the pivot axis of a corresponding one of the operating handles and aligned with the central aperture of a corresponding one of said pivot plates.

14. The electrical system of claim 13 wherein said elongated shaft further includes a longitudinal axis aligned with the pivot axis of one of the operating handles; and wherein the first end of said elongated shaft extends through the central aperture and into the axial bore hole of the adapter coupled to said one of the operating handles.

15. The electrical system of claim 9 wherein said handle attachment includes a base and a pivotable handle coupled to the base; and wherein said pivotable handle is coupled to the second end of said elongated shaft.

16. The electrical system of claim 15 wherein said enclosure includes a cover member; wherein said cover member has a first side facing the interior of said enclosure, a second side facing the exterior of said enclosure, and a thru hole; wherein the second end of said elongated shaft extends through said thru hole; and wherein the base of said handle attachment is mounted to the second side of said cover member.

* * * * *